US009162262B2

(12) United States Patent
Alvestig et al.

(10) Patent No.: US 9,162,262 B2
(45) Date of Patent: Oct. 20, 2015

(54) AUTOMATED DETECTION AND CONTROL SYSTEM AND METHOD FOR HIGH PRESSURE WATER WASH APPLICATION AND COLLECTION APPLIED TO AERO COMPRESSOR WASHING

(75) Inventors: Per G. Alvestig, Ekero (SE); Sebastian Nordlund, Hasselby (SE)

(73) Assignee: EcoServices, LLC, Farmington, CT (US)

( * ) Notice: Subject to any disclaimer, the term of this patent is extended or adjusted under 35 U.S.C. 154(b) by 245 days.

(21) Appl. No.: 13/347,017

(22) Filed: Jan. 10, 2012

(65) Prior Publication Data

US 2012/0103375 A1 May 3, 2012
US 2014/0251392 A9 Sep. 11, 2014

Related U.S. Application Data

(62) Division of application No. 11/938,479, filed on Nov. 12, 2007, now Pat. No. 8,197,609.

(60) Provisional application No. 60/861,401, filed on Nov. 28, 2006.

(51) Int. Cl.

| | |
|---|---|
| ***B08B 3/02*** | (2006.01) |
| ***B08B 9/00*** | (2006.01) |
| ***B08B 3/14*** | (2006.01) |
| ***F01D 25/00*** | (2006.01) |

(52) U.S. Cl.
CPC ... *B08B 9/00* (2013.01); *B08B 3/02* (2013.01); *B08B 3/14* (2013.01); *F01D 25/002* (2013.01)

(58) Field of Classification Search
CPC ..... B08B 3/02; B08B 9/00; B08B 3/14; F01D 25/002
USPC ..... 134/94.1, 95.1, 102.2, 104.4, 166 R, 134/169 A; 60/722
See application file for complete search history.

(56) References Cited

U.S. PATENT DOCUMENTS

| | | | |
|---|---|---|---|
| 4,196,020 | A | 4/1980 | Hornak et al. |
| 5,011,540 | A | 4/1991 | McDermott |
| 5,273,395 | A | 12/1993 | McDermott |
| 5,318,254 | A | 6/1994 | Shaw et al. |

(Continued)

FOREIGN PATENT DOCUMENTS

| | | |
|---|---|---|
| DE | 2701823 | 8/1977 |
| DE | G9420362.8 | 3/1995 |

(Continued)

OTHER PUBLICATIONS

Translation of Decision of granting a patent for invention, in Russian Application 2007144114/06 Alvestig, et al., Nov. 2007.

(Continued)

*Primary Examiner* — Michael Barr
*Assistant Examiner* — Benjamin L Osterhout
(74) *Attorney, Agent, or Firm* — Kinney & Lange, P.A.

(57) ABSTRACT

The present invention relates to a system and method for washing gas turbine engines comprising a manifold comprising one or more tubes; a pumping system for providing pressurized washing liquid to the manifold, the pumping system comprising a pump, and one or more valves; and a control unit for regulating the pumping system according to washing parameters associated to a particular engine.

14 Claims, 2 Drawing Sheets

(56) References Cited

U.S. PATENT DOCUMENTS

| | | | | |
|---|---|---|---|---|
| 5,899,217 | A | 5/1999 | Testman, Jr. | |
| 5,954,070 | A | 9/1999 | Abad et al. | |
| 6,073,637 | A | 6/2000 | Hayward et al. | |
| 6,478,033 | B1 | 11/2002 | Foster | |
| 6,491,048 | B1 | 12/2002 | Foster | |
| 6,675,437 | B1 | 1/2004 | York | |
| 6,932,093 | B2 | 8/2005 | Ogden et al. | |
| 2001/0049846 | A1 | 12/2001 | Guzzi et al. | |
| 2002/0001255 | A1 | 1/2002 | Flood et al. | |
| 2002/0129837 | A1 | 9/2002 | Ruiz et al. | |
| 2003/0209256 | A1 | 11/2003 | Tadayon | |
| 2005/0199270 | A1 | 9/2005 | Watt | |
| 2006/0048796 | A1 | 3/2006 | Asplund et al. | |
| 2006/0060233 | A1* | 3/2006 | Lakdawala et al. | 134/169 A |
| 2006/0081521 | A1 | 4/2006 | Hjerpe et al. | |
| 2009/0050183 | A1 | 2/2009 | Rice et al. | |

FOREIGN PATENT DOCUMENTS

| | | | |
|---|---|---|---|
| EP | O628477 | | 12/1994 |
| EP | 0933502 | | 8/1999 |
| EP | 1205640 | A2 | 5/2002 |
| JP | 3-13834 | | 6/1988 |
| JP | 06058172 | | 3/1994 |
| JP | 08128333 | | 5/1996 |
| KR | 10-19980017193 | | 6/1998 |
| KR | 1020070042852 | A | 4/2007 |
| SU | 319745 | | 1/1971 |
| SU | 1755965 | | 8/1992 |
| SU | 1767205 | | 10/1992 |
| SU | 2000458 | | 9/1993 |
| WO | WO2005/077554 | A1 | 8/2005 |
| WO | WO2005/120953 | A1 | 12/2005 |
| WO | WO2005/121509 | A1 | 12/2005 |
| WO | WO2007/102738 | A1 | 9/2007 |

OTHER PUBLICATIONS

Taiwan Office Action, mailed Mar. 21, 2011, in Taiwan Patent Application No. 096145214 to Alvestig, et al.

Search and Examination Report from UAE Application Serial No. 1109/2007, dated Nov. 10, 2014, 10 pages.

* cited by examiner

AUTOMATED DETECTION AND CONTROL SYSTEM AND METHOD FOR HIGH PRESSURE WATER WASH APPLICATION AND COLLECTION APPLIED TO AERO COMPRESSOR WASHING

CROSS-REFERENCE TO RELATED APPLICATION(S)

The present application is a divisional patent application of U.S. application Ser. No. 11/938,479, filed Nov. 12, 2007. All references are incorporated herein.

TECHNICAL FIELD

The present invention relates generally to turbine engines. More particularly, the present invention relates to systems and methods for cleaning turbine engines, thereby ensuring quality, performance, and safety of cleaned engines.

The present invention relates generally to turbine engines. More particularly, the present invention relates to systems and methods for cleaning turbine engines, thereby ensuring quality, performance, and safety of cleaned engines.

BACKGROUND

A conventional gas turbine installed as an aircraft engine typically comprises a compressor for compressing ambient air, a combustor for burning fuel together with compressed air, and a turbine for converting the expanding air from the compressor/combustor to usable power. In operation, the gas turbine is driven by expanding combustion gases. These combustion gases also drive a fan component which is connected to the turbine in order to produce thrust used for propelling, for example, an air craft, As known to those skilled in the art, a compressor is a key component of any gas turbine, as it typically consumes roughly sixty percent (60%) of the energy needed to produce the resulting torque or thrust. As a result, management of compressor efficiency is a key consideration for any gas turbine operator.

Gas turbines engines consume large quantities of air. Air contains foreign particles including, for example, aerosols and solids. These foreign particles enter gas turbine compressors when gas turbine engines are running. The majority of the foreign particles will follow the gas path and exit a turbine engine together with exhaust gases. Other types of air contaminants, such as those found in an aerodrome environment, include pollen, insects, engine exhaust, leaking engine oil, hydrocarbons coming from industrial activities, salt coming from nearby sea, chemicals coming from aircraft de-icing and airport ground material such as dust.

After a period of operation of an aircraft gas turbine engine, a coating of these foreign particles and/or contaminants tends to builds up in engine's compressor. This build-up is also known as compressor fouling. As known to those skilled in the art, compressor fouling causes a change in the properties of the boundary layer air stream of the engine's components. In addition, the compressor fouling increases the compressor's surface roughness.

A turbofan engine is designed for providing a high thrust level for use in aircrafts operating at subsonic velocities. As a result, turbofan engines are widely used in commercial passenger aircraft applications. Typically, turbofan engines comprise a fan and a core engine. The fan is installed upstream of the engine's compressor, and consists of one rotor disc with rotor blades and alternatively, a set of stator vanes downstream of the rotor. The fan is driven by the power from the core engine. The core engine is a gas turbine engine designed such that power for driving the fan is taken from a core engine shaft. While the engine is running, prime air enters the fan.

As discussed above with regard to gas turbine compressors, the fan of a turbofan engine is also susceptible to fouling caused by air contaminants/particles such as insects, pollen, birds, etc. This fan fouling is typically removed by washing using cold or hot water only. As known to those in the art, cleaning fan fouling is a relatively easy process to perform.

As noted above, in a turbofan engine, downstream of the fan is the core engine compressor. Significant for the compressor is its ability to compress air to high pressure ratios. In performing its compression work, the compressor will experience a temperature rise. The temperature rise in a high pressure compressor may be as high as five-hundred (500) degrees Celsius. As a result of these high temperatures, any fouling that collects on the compressor is effectively "baked" onto the surface of the compressor, making it extremely difficult to remove.

Analyses have shown that compressor fouling comprising hydrocarbons, residues from anti icing fluids, salt, and/or the like are more difficult to remove than other types of fouling.

In an effort to remove engine compressor fouling, a number of cleaning or washing techniques have been developed. For example, one such compressor cleaning system is disclosed in International Publication No. WO 05077554, titled "Method and Apparatus for Cleaning Turbofan Gas Turbine Engines" and its corresponding United States Published Patent Application No 2006/0048796. Disclosed therein is a cleaning device comprising a plurality of nozzles arranged on a stiff manifold, which manifold is releasibly mounted on the air inlet of the engine, and where the nozzles are arranged to atomize and direct cleaning liquid in the air stream up-stream of a fan of the engine.

The device as disclosed in WO 05077554 comprises a first nozzle arranged at a first position relative a centre line of the engine such that the cleaning liquid emanated from the first nozzle impinges the surfaces of the blades substantially on the pressure side; a second nozzle arranged at a second position relative the centre line of the engine such that the cleaning liquid emanated from the second nozzle impinges the surfaces of the blades substantially on the suction side; and a third nozzle arranged at a third position relative the centre line of the engine such that the cleaning liquid emanated from the third nozzle passes substantially between the blades and enters an inlet of the core engine. A specific design washing configuration is prepared for each specific engine and flow rate such that atomization and nozzle position are optimized to achieve effective cleaning.

Thus, the invention disclosed in WO 05077554 is based on the insight that the engine geometry and properties of the fouling of different components of the engine have different properties and therefore, require different approaches for the cleaning. As an example, the fouling of a core compressor may have different properties than fouling found on the blades of a fan. One possible reason for this discrepancy in fouling properties may include, for example, that the temperature is much higher at the compressor than at the blades of a fan. The high temperature at the compressor results in fouling particles becoming "baked" onto the compressor's surface, thereby making removal of such fouling extremely difficult. At the fan blades, however, the temperature is much lower. As a result, the fouling at the fan does not become baked, making it much easier to clean fan fouling.

The cleaning solution disclosed in WO 05077554 provides several advantages over the existing solutions. One advantage is that each engine part is cleaned according to the particular properties of the fouling collected thereon. To illustrate, since the fouling collected on a compressor is usually baked on and thus, much more difficult to remove than say, fouling that gathers on the blades of a fan, the cleaning process each of these components may be adapted accordingly. As a result, the engine as a whole (i.e., the entirety of the engine parts exposed to fouling) may be cleaned more effectively and efficiently as compared to conventional engine cleaning methods, which typically utilize a uniform cleaning process for cleaning all engine parts. To this end, this device provides each engine component with a specific washing nozzle design, configuration, and optimized washing procedure that is selected in order to maximize the effectiveness/efficiency of the overall engine wash procedure.

Another aspect of the cleaning aircraft engines includes the proper collection and disposal of washing liquids used to clean the engines, and any contaminants removed from the engines during a cleaning process. Due to environmental concerns, used washing liquids may be purified and recycled, such as is described in International Publication No. WO 05120953, titled "System and Devices for Collecting and Treating Waste Water from Engine Washing". Disclosed therein is a device having a collector arranged at the rear arrangement for engine washing. Waste wash liquid emanating from an engine is collected by this collecting device at the rear of the engine.

Another example of a waste water collecting device is described in International Publication No. WO 05121509, titled "System and Devices for Collecting and Treating Waste Water from Engine Washing", and its corresponding United States Published Patent Application No. 2006/0081521. As disclosed therein, collected waste liquid is pumped into a tank where released fouling material is separated from the collected liquid by an appropriate waste water treatment process. The treated water is then used for either washing additional engines or is alternatively dumped into a sewer.

The above mentioned systems for cleaning engines and/or collecting and recycling used washing liquids provide very versatile and effective cleaning methods that can be arranged on a mobile unit. These processes, however, are all dependent to some extent upon an operator manually making certain adjustments and/or system settings.

When an aircraft engine is to be washed, for example, an operator is provided with information regarding the engine type and collects a manifold that is adapted to that engine from a storage place. When in position at the aircraft, the manifold is attached to the inlet of the engine and connected to the washing system. The operator is further provided with information regarding the requirements for washing that particular engine type, such as maximum water flow per time unit and the total amount of washing water. The operator then manually sets the valves to the manifold nozzles in order to obtain the appropriate pressure and flow and keeps track of the washing time.

Since this part of the washing operation is done manually there is always a risk that the human factor jeopardizes the result, and in particular since many engine washing operations are performed during night-time when the operators may not be fully alert. If the requirements regarding the particular engine are not followed, the engine may be damaged, leading to a very costly standstill of the aircraft or that the result of the washing procedure is inferior, whereby the benefits of an engine wash are not obtained.

It would therefore be beneficial for such a closed loop washing process if the influence of the human factor is minimized as much as possible.

SUMMARY

The present invention discloses in one embodiment a system and method for washing gas turbine engines comprising a manifold comprising one or more tubes; a pumping system for providing pressurized washing liquid to the manifold, the pumping system comprising a pump, and one or more valves; and a control unit for regulating the pumping system according to washing parameters associated to a particular engine.

An aspect to be accomplished by certain embodiments of the present invention is to provide a system and method that can ensure a higher degree of quality of an engine washing procedure, so as to minimize the risk of wrongly operating the equipment and to collect results from the wash to accept engine cleanliness and log what material is causing the fouling to plan future washes on similar equipment.

Another aspect may be characterised by a system for washing a gas turbine engine, wherein the system comprises a manifold comprising one or tubes arranged with one or more nozzles, the manifold being connectable to a wash liquid tank and pump, capable of providing pressurized and directionally placed wash liquid to said manifold, the pump having one or more valve means arranged between the pump and the manifold for regulating the flow of pressurized wash liquid. A control means is connected to the one or more valve means for controlling the flow of pressurized wash liquid, identification means arranged to said manifold. An optional identification unit and detection unit are also provided for providing manifold and engine information to the control unit.

According to another aspect, the control unit is configured to regulate a washing time, and to select an appropriate washing liquid/solution for use with a particular engine type.

According to yet another aspect, a feedback loop is provided for measuring removed solids to determine when a washing procedure is acceptable and to analyze the removed fouling material for comparison to a solubility data base to plan the wash fluid composition and cycle for similar and future washes. This later aspect has been outlined in U.S. Provisional Patent Application No. 60/852,041, titled System And Method For Optimized Gas Turbine Compressor Cleaning and Performance Measurement.

Embodiments of the present invention provides for a higher degree of safety and quality regarding wash results obtained in that the washing system is automated. As a result, any human error introduced into the system is greatly reduced.

Since one aspect of the present invention includes an RFID chip and reader for identifying the manifold and thus, the type of engine, a cost-efficient and reliable system is obtained. This is also true for the use of a PLC for controlling the washing operation, which also may be used for controlling other functions of the system, collecting data from other sensors like temperature sensors for the wash liquid, conductivity sensors for measuring the TDS (Total Dissolved Solids) which can be used as a measure of the quality of the washing operation, etc. By logging the use of the manifold applied, the manifold usage can be tracked allowing the manifold to be serviced prior to failure and release of foreign material into the turbine. If the wash system is implemented as a closed loop system, i.e., the wash liquid is collected, cleaned and fed back to the washing unit, the control unit (e.g., PLC) can be used for controlling, measuring and regulating these functions.

These and other aspects of and advantages with the various embodiments of the present invention will become apparent from the following detailed description and from the accompanying drawings.

DETAILED DESCRIPTION

The present invention relates to systems and methods for washing gas turbine engines, and in particular, aircraft turbine engines. A washing system in accordance with an embodiment of the present invention comprises a washing unit for providing a washing liquid into an engine and a control unit for regulating the washing unit according to desired parameters. In one embodiment, the washing unit comprises a manifold, preferably comprising one or more tube-like structures, a pumping system for providing pressurized washing liquid to the manifold, and a control unit for controlling the system's washing procedure according to the particular wash requirements of the particular engine being washed.

Figure 1:
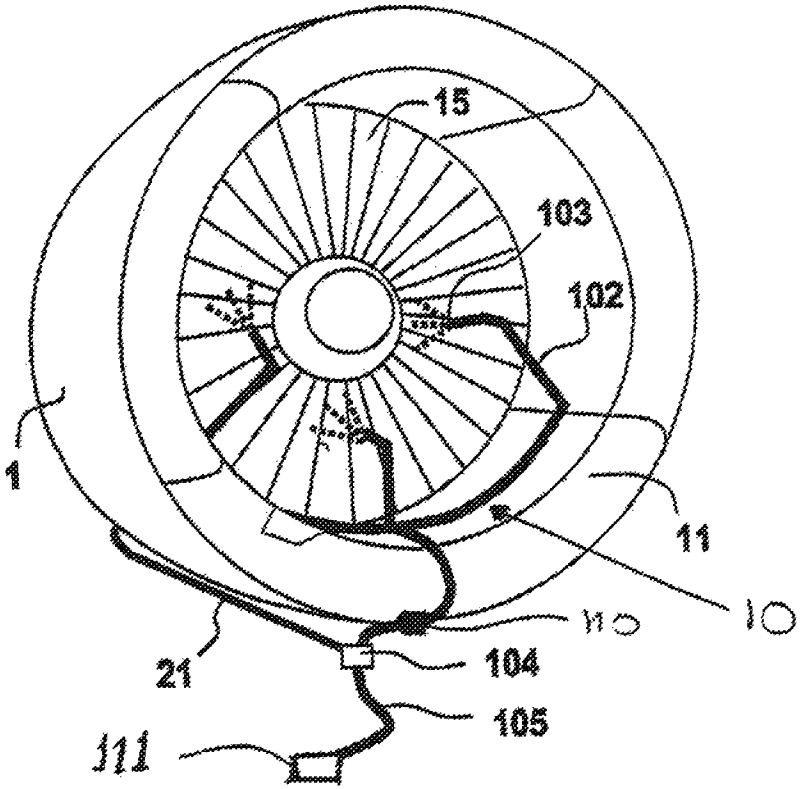
FIG. 1 an exemplary manifold installed in an inlet of an aero engine in accordance with an embodiment the present invention.

Referring now to FIG. 1, an exemplary manifold 10 configured in accordance with the present invention is shown mounted on an exemplary aero engine 1. The manifold 10 comprises a plurality of tube-like structures 102, a plurality of nozzles 103, one each connected to one end of the manifold tubes 102, a coupling device 104 for coupling the other end(s) of the manifold tubes 102, and a hose 105 connected to the coupling device 104 for providing an ingress of washing liquid provided by a pumping system (not shown). Preferably, the manifold 10 may further comprise an information unit 110, such as a manifold identification unit 110, for identifying the type of manifold 10 currently being utilized. This information unit 110 may be attached to any portion of the manifold 10 itself, or to some portion of the coupling device 104.

A suitable information unit 110 preferably comprises a radio-frequency identification (RFID) chip or tag. As known to those in the art, an RFID-chip or tag can be described as a small microchip that function as transponders, adapted to "listening" for radio signals sent by transceivers (e.g., RFID-reader). When an RFID chip or tag receives a certain radio query, it responds by transmitting its unique identification code and other information, back to the transceiver. One benefit of using RFID chips or tags is that they do not require batteries to operate; instead, they are powered by the radio signals transmitted by transceivers.

Although RFID chips or tags are preferred, it should be understood that any suitable information unit 110 may be utilized in accordance with the present invention. Other suitable information units 110 may comprise, for example, bar code labels, optical readers for obtaining pertinent information from the bar code, radio frequency equipment capable of transmitting and receiving information, etc.

As will be discussed below with reference to FIG. 2, if the particular manifold 10 comprises an information unit 110, then a corresponding information detector 111 is also desirable for reading information provided by the information unit 110, and for providing this information to a control unit (see FIG. 2, item 112).

In operation, when an engine 1 is to be washed, a manifold 10 configured for the particular type of engine 1 is releasably mounted and secured to an inlet 11 of the engine 1. Any suitable securing means, such as for example, a strap or similar device may be utilized to secure the manifold 10 in place. Once the manifold 10 is secured to the engine inlet 11, a hose 105 is connected to the coupling device 104 for providing ingress of washing liquid to the engine 1.

The washing system may also include a collector unit for collecting used washing liquid that emanates from an engine as a result of the washing procedure. In certain embodiments, the control unit may be responsive to characteristics of the used washing liquid emanating from the engine in order to regulate the washing unit. For example, an analyzing device may be utilized to evaluate the used washing liquid to determine various characteristics, such as types of solids within the used washing liquid. Depending on the results of the evaluation of the used washing liquid, the control unit may then adjust the washing unit to alter the parameters of the washing procedure.

Figure 2:
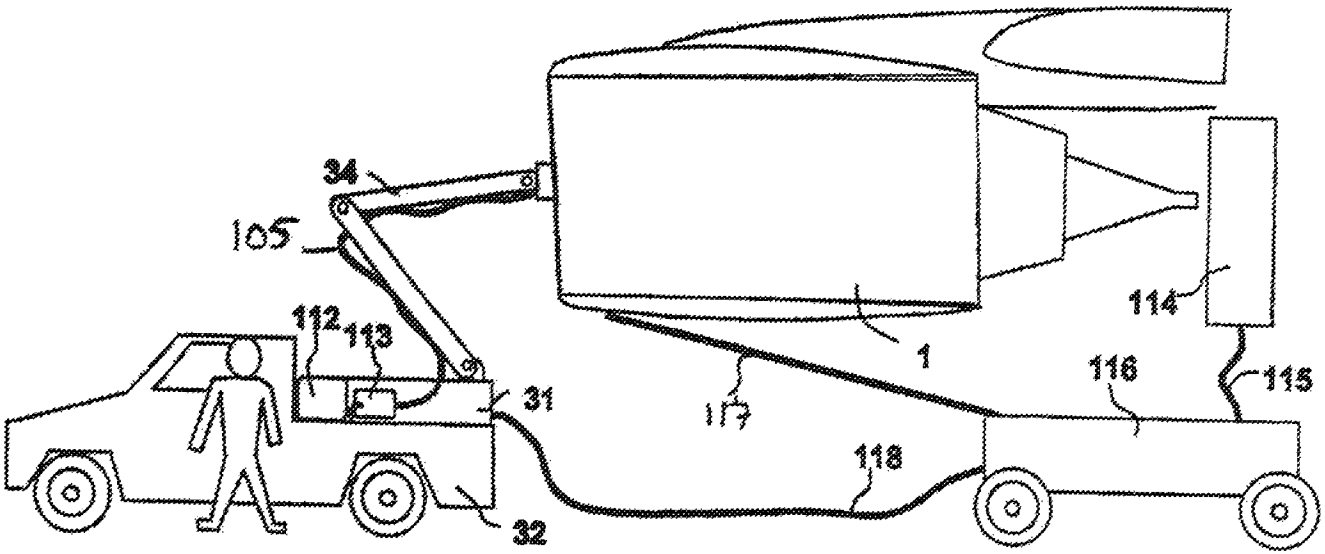
FIG. 2 illustrates an exemplary washing system according to an embodiment of the present invention comprising a mobile unit.

Referring now to FIG. 2, an exemplary implementation of a washing system in accordance with an embodiment of the present invention is shown. The exemplary washing system comprises the manifold 10 illustrated in FIG. 1, an optional mobility unit 32 comprising a vehicle connected to an optional used washing liquid collector 116, a valve-pumping system 113 comprising a tank 31 and a pump (not shown) for regulating the flow of washing liquid, and a control unit 112 for controlling and monitoring the washing process according to the particular engine 1 being washed. In a preferred embodiment, the pumping system 113 is configured to provide pressurized, forty (40) to eighty (80) bar washing liquid to the manifold 10.

In addition, the exemplary washing system of FIG. 2 preferably comprises a collecting device 114 for collecting used washing liquid, a conduit 118 for providing the used washing liquid to a tank 31 for storing washing liquid and treating used washing liquid.

Thus, once the hose 105 is connected to the manifold 10, which as discussed above, is configured according to the particular engine type being washed, the information detector 111 obtains particular information identifying the engine 1 type from the information unit 110. This identification is then transmitted to the control unit 112. As noted above, an exemplary information unit 110 may comprise an RFID reader. In such a case, the corresponding information detector 111 preferably comprises an RFID reader.

The control unit 112 preferably comprises a programmable logic controller (PLC) capable of being programmed to control and monitor the washing process. It should be understood, however, that the control unit 112 is not limited thereto, and other suitable control units may also be implemented where desired.

The control unit 112 is preferably pre-programmed with control data for washing any number of engine types. This control data may include, for example, manifold configurations, washing requirements, washing parameters, etc. In addition, the control data may include data relating to particular geographies and expected fouling configurations. With such control data, the control unit 112 can load a specific washing program for the particular engine type. If based on the control data the control unit 112 determines that a combination of several washing liquids is preferred, the washing system of the present invention preferably comprises several tanks containing different types of wash liquids for use in achieving the preferred washing solution.

Additionally or optionally, the control unit 112 may be configured to look up data related to solution capabilities of particular washing liquids in order to predict or select an optimized washing process for a particular engine used in a particular mission or geography. This and other information gathered and provided to the control unit 112 is preferably uploaded to an integrated system (not shown) for use by other washing systems.

Once the control unit 112 receives the identity information provided by the information detector 111, and receives any control data associated with the engine 1, the control unit 112 is able to determine the washing requirements and preferred washing parameters for the engine 1 being washed. Once these preferred washing parameters are established, the washing system of the present invention is ready to be initiated.

Upon initiating the preferred washing procedure, the control unit 112 directs the opening of one or more valves of the valved-pumping system 113 until a desired flow of washing fluid is obtained. This fluid flow may be measured, for example, via a flow meter (not shown) and feed back provided to the control unit 112. As known by those in the art, the washing fluid may be controlled via, for example, regulating the pressure of the tank (not shown) in which the washing fluid is stored. Preferably, the control unit 112 is configured to regulate such pressure. In addition, the control unit 112 is also configured to regulate a washing time for the particular engine being washed. In this manner, the control unit 112 may shut down the valve in order to shut down the pumping system 113, once the preferred washing time has been reached.

In a preferred embodiment, the control unit 112 is further configured (or programmed) to measure and collect information regarding a number of parameters and functions in connection with an engine washing process. For example, control unit 112 may be configured to process temperature data, say from a temperature gauge (not shown), in order to delay initiating a washing procedure until the washing fluid has reached a predetermined washing temperature. Additionally, the control unit 112 may comprise an optional operator interface (not shown) capable of displaying different control and process information to a user.

Referring back to FIG. 2, the optional mobile used fluid collector 116 is preferably positioned under the engine 1 for use in collecting used washing liquid and any contaminants that exit the engine 1 as a result of a washing process. An exemplary fluid collector is disclosed in International Publication No. WO 05121509 and corresponding United States Published Patent Application No. 2006/0081521, the entire contents of which are incorporated herein by reference. Although this used-fluid collector 116 is shown having wheels (for mobility), it should be understood that the used fluid collector 116 of the present invention is not necessarily required to be mobile.

During any washing process, used wash liquid together with engine contaminants will emanate from the engine 1. A collection device 114 positioned at a rear of the engine 1, and a trough 117 positioned under the engine 1, may be utilized to collect this used wash liquid and engine contaminants. An exemplary collection device 114 is described in International Publication No. WO 05120953, the entire contents of which are incorporated herein by reference. The collection device 114 may be at spaced separation from the engine 1, such as shown herein, or alternatively in contact with any part of the engine 1, such as the engine outlet. In addition, although not shown, a conduit may be utilized between the engine and the collection device. In certain embodiments, a conduit may be utilized having an opening at one end sized so as to be at least as large as the diameter of the engine outlet, and then in use positioned adjacent to or in contact with the engine, so as to capture the used wash liquid and engine contaminants emanating from the engine outlet. In certain embodiments the conduit may be in the form of a mist eliminator, for separating air from liquid, such as by allowing the air to escape out through openings or valves in the conduit.

The collected waste liquid and contaminants may enter a tank (not shown) in the used fluid collector 116 via, for example, a conduit 115. The used washing liquid may then be pumped via, for example, a conduit 118 to a tank (not shown) in the washing unit 31 located on the mobility unit 32. The washing unit 31 is preferably configured to treat the used washing fluid by separating any fouling material from the used washing liquid via an appropriate liquid treatment process This liquid treatment process may comprise the use of devices such as filters, centrifuges, separators, and the like. Once the used liquid is treated, the liquid may be reused to wash a subsequent engine, or alternatively, it may simply be disposed.

In a preferred embodiment, the control unit 112 is further configured to analyze used washing liquid collected by the fluid collector 116. To illustrate, a Total Dissolved Solids (TDS) may be measured by a measuring means arranged, for example, in the fluid collector 116. As known to those in the art, TDS is measured by measuring the conductivity of used washing liquid. Based on these measurements, the types of solid(s) included in the used liquid may be determined. Measuring means such as sensors, for example, may be used to measure TDS. Once the TDS is collected, the measurements may be provided to the control unit 112, wherein the washing procedure (e.g., the wash time, wash temperature, washing fluids, etc.) may be adjusted so as to optimize the time and efficiency of the current washing process.

It is to be understood that the embodiments described above and shown in the drawings are only to be regarded as non-limiting examples of the present invention and that it may be modified within the scope of the patent claims.

The invention claimed is:

1. A system for washing turbine engines comprising:

a washing unit for providing a washing liquid to the turbine engines;

an information detector configured to gather information related to engine type; and a control unit configured to accept the information related to engine type from the information detector and to determine a washing program to be used as a function of the information relating to engine type from a set of preprogrammed washing programs, and further configured to regulate the washing unit according to washing parameters associated with the washing program used.

2. The system of claim 1, wherein the washing unit further comprises a manifold comprising one or more tubes;

a pumping system for providing pressurized washing liquid to the manifold, with the pumping system comprising a pump and one or more valves;

one or more nozzles, one each connected to one end of the one or more tubes; and wherein the control unit regulates the pumping system.

3. The system of claim 2, further comprising a hose for connecting the manifold to the pumping system, wherein the pumping system configured to provide forty (40) to eighty (80) bar pressurized washing liquid, and wherein the one or more valves is configured for use in regulating the flow of the pressurized washing liquid.

4. The system of claim 3, wherein the control unit is further configured to regulate the flow of pressurized washing liquid.

5. The system of claim 4, further comprising an information unit connected to the manifold for providing information relating to said manifold.

6. The system of claim 5, wherein the information detector comprises an information detector for reading information provided by the information unit, and for providing said information to the control unit.

7. The system of claim 6, wherein the information unit is a manifold identification unit for providing information related to the manifold's type.

8. The system of claim 7, wherein the information unit is a radio-frequency identification (RFID) unit, and wherein the information detector is a RFID reader.

9. The system of claim 1, wherein the information provided by the information detector is used by the control unit to regulate a washing time.

10. The system of claim 9, wherein the information provided by the information detector is used by the control unit to select a washing liquid type.

11. The system of claim 9, wherein the control unit is a programmed logic controller (PLC), said PLC being configured to washing preparation, washing delivery, fouling collection, used washing liquid treatment, and overall washing effectiveness for use in future optimization of a washing process.

12. The system of claim 11, further comprising a temperature sensor in communication with the control unit for measuring a temperature of washing liquid, the control unit using the measured temperature for regulating a washing procedure.

13. A system for washing turbine engines comprising:

a washing unit for providing a washing liquid to the turbine engines;

an information detector configured to provide information identifying at least one of manifold configuration, expected fouling composition, solution capability, geographic use and engine mission usage; and a control unit configured to regulate the washing unit according to washing parameters based upon preprogrammed control data relating to information provided by the information detector, wherein the preprogrammed control data comprises a washing program from a set of available washing programs.

14. A system for washing turbine engines comprising:

a washing unit for providing a washing liquid to the turbine engines;

an information detector for providing information identifying at least one of washing unit and engine type; and a control unit configured to regulate the washing unit according to washing parameters associated to a particular engine based upon preprogrammed control data relating to information provided by the information detector, wherein the preprogrammed control data comprises a washing program from a set of available washing programs.

* * * * *